US005267731A

United States Patent [19]

Gruber

[11] Patent Number: 5,267,731

[45] Date of Patent: Dec. 7, 1993

[54] SOLITAIRE GAME

[76] Inventor: Fritz Gruber, Bahnhofstr. 118, 8085 Geltendorf, Fed. Rep. of Germany

[21] Appl. No.: 777,567

[22] PCT Filed: Apr. 28, 1990

[86] PCT No.: PCT/EP90/00691

§ 371 Date: Feb. 7, 1992

§ 102(e) Date: Feb. 7, 1992

[87] PCT Pub. No.: WO91/16959

PCT Pub. Date: Nov. 14, 1991

[51] Int. Cl.[5] ..... A63F 9/08

[52] U.S. Cl. ..... 273/153 S

[58] Field of Search ..... 273/153 S, 155, 153 R

[56] References Cited

U.S. PATENT DOCUMENTS

| | | | |
|---|---|---|---|
| 2,807,471 | 9/1957 | Moore | 273/155 |
| 4,410,179 | 10/1983 | Rubik | 272/153 S |
| 4,767,120 | 8/1988 | Ho | 273/153 S |
| 4,832,343 | 5/1989 | Bernat | 273/153 S |

FOREIGN PATENT DOCUMENTS

| | | | |
|---|---|---|---|
| 3135444 | 4/1983 | Fed. Rep. of Germany . | |
| 8307792 | 6/1983 | Fed. Rep. of Germany . | |
| 3221120 | 12/1983 | Fed. Rep. of Germany | 273/153 S |
| 3821297 | 12/1989 | Fed. Rep. of Germany . | |
| 1319885 | 6/1987 | U.S.S.R. | 273/153 S |
| 1321436 | 7/1987 | U.S.S.R. | 273/153 S |
| 1400630 | 6/1988 | U.S.S.R. | 273/153 S |
| 2116049 | 9/1983 | United Kingdom | 273/153 S |

*Primary Examiner*—V. Millin
*Assistant Examiner*—Steven B. Wong
*Attorney, Agent, or Firm*—Lowe, Price, LeBlanc & Becker

[57] ABSTRACT

A solitaire game is essentially composed of a parallelepipedic body (1) with two square opposite front faces (1*a*) and four semicircular disks (2) fastened to the four longitudinal edges (1*c*) of the parallelepipedic body (1)- so as to pivot over 90°. At the periphery of each semicircular disk (2) are arranged two quarter circle ring segments (3) that can slide along the circular arc periphery of each semicircular disk (2). This solitaire game is characterized by very complex playing possibilities associated to a simple, compact structure.

5 Claims, 3 Drawing Sheets

Fig. 1
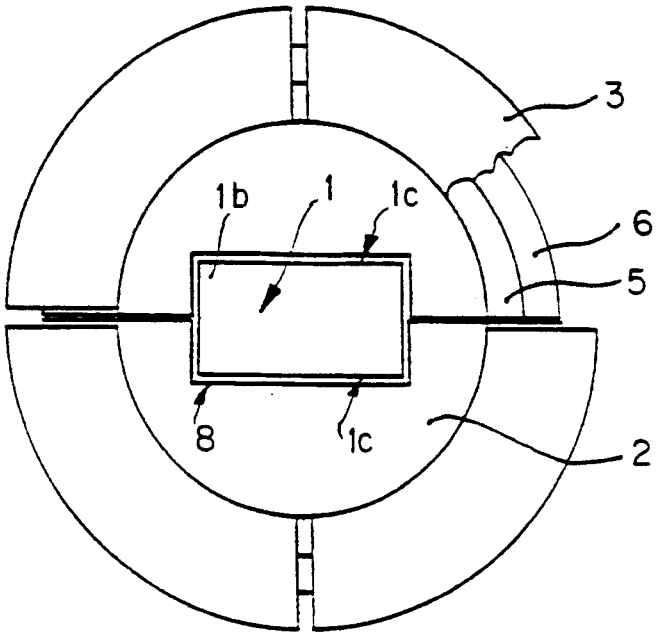
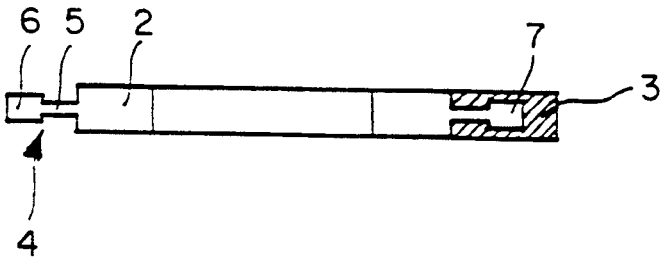
Fig. 2

SOLITAIRE GAME

The invention relates to a solitaire game.

PRIOR ART

There are known several solitaire games whose principle is to move a body comprising movable individual elements from a home position by moving the individual elements which are differently marked randomly to a disordered condition followed by the attempt to restore the initial condition.

The German utility model G 83 07 792 discloses, for example, a disk puzzle comprising two overlapping circular disks arranged in a frame on a base plate. Considered as such, each circular disk comprises six disk parts each in the form of an equilateral triangle. Between each two adjacent disk parts there is inserted a bar with two diametrically opposing bars being secured to a central turning knob and serving upon turning of the turning knob as a dog for the rest of the movable bars and disk parts. Since these dog bars extend in the same plane as the rest of the bars and the disk parts, a mutual meshing of the dogs in certain turning positions may occur resulting in a blocking of the game such that the game complexity is not very high.

The German laid open patent application 31 35 444 discloses a solitaire game whose basic body is a sphere in the exterior surface of which three circular guiding grooves intersecting each other are incised. The surface of the sphere is subdivided by the predetermined guiding grooves into eight triangular sphere segments colored with eight different colors. Square type sliding elements are inserted into these guiding grooves the colors of which correspond to those of the associated spheric segment. Turning the sliding elements being in home position several times in various directions results in a disordered condition with the task for the player to restore the initial position determined by the coloration. Since the guiding elements and, correspondingly, the portions of the sliding elements engaging them extend in two directions in an arc-type form manufacturing thereof is expensive since otherwise the movement of the sliding stones will cause considerable problems. Furthermore, in order to achieve a maximum game complexity the diameter of the sphere must be relatively large which complicates accommodation thereof in a pocket of a jacket or pant.

SUMMARY OF THE INVENTION

Therefore, it is the object of the invention to suggest a solitaire game having a high complexity with a simple compact design. This object is solved by the features of the present invention.

According to the invention, all semicircular disks may be brought into similar alignment for transporting the game, the game may be put into any pocket. By pivoting the semicircular disks, each semicircular disk may be placed into one plane with any of the two adjacent semicircular disks such that the quadrant segments provided at the exterior periphery of the semicircular disks may be placed onto the one or other adjacent semicircular disk. Thus any quadrant segment may be placed on any desired semicircular disk by shifting the rest of the quadrant disks. The home position of the game is determined by the fact that a corresponding color is assigned to each surface of the semicircular disk and the surfaces of the two quadrant segments associated to the corresponding semicircular disk.

BRIEF DESCRIPTION OF THE DRAWING

The invention will be explained below referring to the drawing. There are shown in FIG. 1 a plan view of an embodiment of a solitaire game;

FIG. 2 a front view of a semicircular disk;

MODE OF CARRYING OUT THE INVENTION

Figure 3:
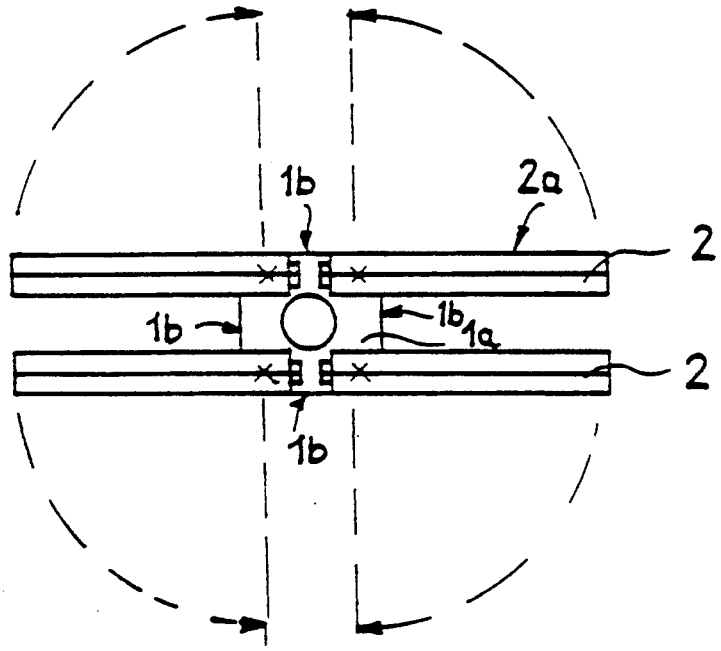
FIG. 3 a front view of the solitaire game.

As may be seen from FIGS. 1 and 3, the solitaire game essentially comprises a basic body 1 in the form of a rectangular parallelepiped whose two opposing end surfaces 1*a* are of generally square form, and four semicircular disks 2 arranged adjacent the four longitudinal edges 1*c* of body 1. Each semicircular disk is pivotally mounted to body 1 to permit 90° pivoting movement, see FIG. 3. Thus, the rotational axes of the semicircular disks 2 extend in parallel to the longitudinal edges 1*c* of body 1.

Two quadrant segments 3 are provided at the exterior periphery of each semicircular disk 2 and are shiftable along the exterior periphery of the semicircular disk 2. As may be seen from FIGS. 1 and 2 for this purpose each semicircular disk 2 is provided along its circular arc with a projection 4 comprising a bar 5 secured to the semicircular disk 2 and a bead 6 secured to the free end of bar 5. On the other hand, the quadrant segments 3 are provided at the side facing the semicircular disk 2 with a guiding groove 7 the form of which matches the exterior shape of bar 5 and bead 6. Thus, quadrant segment 3 may be shifted onto projection 4 from the side of the baseline of the semicircular arc with the guiding groove 7 housing projection 4. Engagement of quadrant segment 3 in a radial direction is provided by bead 6 of projection 4.

In order to have two semicircular disks 2 pivoted into one plane to form a closed circular surface around the periphery of which four quadrant segments 3 in total may be shifted, there is provided a recess 8 in respect of the center of each semicircular disk 2 which recess 8 corresponds to have the side surfaces 1*b* of body 1. If two semicircular disks 2 are located in one plane, the two recesses 8 accommodate one side surface 1*b* of body 1 such that as a whole a closed surface is formed.

The four pivoting axes of the semicircular disks 2 thus extend through the four corner regions of the end surfaces 1*a* of body 1 with the four edges 1*c* of the body 1 parallel to the axes rotation being rounded off (not shown) for easier pivoting semicircular disks 2.

Figure 4:
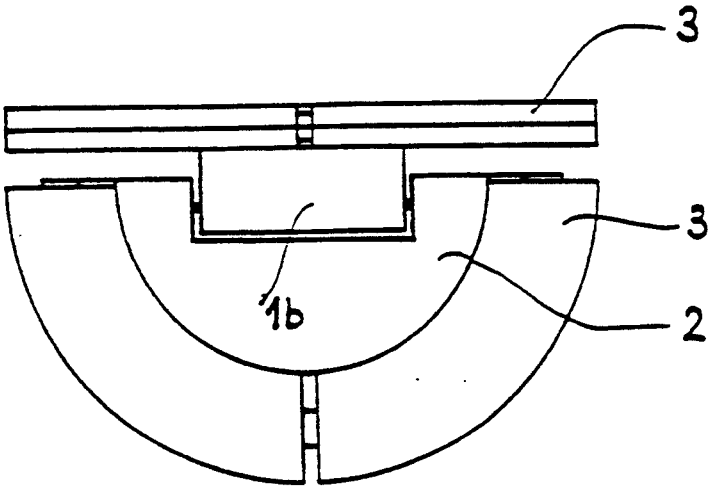
FIG. 4 a longitudinal view of the solitaire game.

As may be gathered from FIG. 3, only a small space is required for the solitaire game in a situation when all semicircular disks 2 extend in one direction. As may be seen in FIG. 4, the two semicircular disks 2 not actuated automatically fold down such that the shifting of the quadrant segments 3 of the two semicircular disks aligned in a common plane is easily and conveniently possible.

Since the guiding grooves 7 of the quadrant segments 3 and the projections 4 of the semicircular disks 2 are aligned in two dimensions only, manufacture is cheap.

I claim:

1. A solitaire game comprising:

a) a body having a rectangular parallelepiped form, said body having two opposing side surfaces generally square in shape, and opposing top and bottom rectangular surfaces; and b) for semicircular disks, each semicircular disk having an arc-shaped peripheral edge and being mounted to said body for 90° rotation with respect to a plane parallel to said top and bottom rectangular surfaces, each semicircular disk including a pair of quadrant segments, each pair of quadrant segments mounted on a said peripheral edge of a said semicircular disk for sliding movement therealong.

2. The solitaire game of claim 1 wherein each said peripheral edge comprises a bead and a bar, said bar interconnecting said semicircular disk and said bead, and each said quadrant segment having a groove on a side facing said peripheral edge and matching a shape of said bead and bar for engagement therewith to accommodate said sliding movement.

3. The solitaire game of claim 1 wherein each said semicircular disk has a recess in a body portion thereof, each said recess corresponding generally to one half of a said top or bottom rectangular surface of said body to facilitate said 90° rotation.

4. The solitaire game of claim 1 wherein each said semicircular disk is pivotally mounted on said two opposing surfaces on a pivoting axis, each said pivoting axis of each said semicircular disk extending through a corner region of each of said two opposing surfaces such that a pivoting end position of one semicircular disk is located in one plane with a pivoting end position of an adjacent semicircular disk such that said quadrant segments may be shifted between said one and said adjacent semicircular disks positioned in said one plane through said 90° rotation.

5. The solitaire game to claim 1 wherein edges of said body parallel to said pivoting axes are mounted to facilitate said 90° rotation.

* * * * *